United States Patent [19]

Görlach

[11] 4,174,122

[45] Nov. 13, 1979

[54] SKI-BINDING DEVICE FOR CROSS-COUNTRY SKIS

[76] Inventor: Hans Görlach, Gablonzer Ring 17-19, Kaufbeuren-Neugablonz, Fed. Rep. of Germany

[21] Appl. No.: 880,356

[22] Filed: Feb. 23, 1978

[30] Foreign Application Priority Data

Feb. 23, 1977 [DE] Fed. Rep. of Germany ... 7705310[U]

[51] Int. Cl.[2] ..... A63C 9/00

[52] U.S. Cl. ..... 280/615

[58] Field of Search ..... 280/614, 615

[56] References Cited

U.S. PATENT DOCUMENTS

| | | | |
|---|---|---|---|
| 3,907,319 | 9/1975 | Berlied, Jr. | 280/615 |
| 4,017,096 | 4/1977 | Pinsonnault | 280/615 |
| 4,043,570 | 8/1977 | Riikonen | 280/615 |

FOREIGN PATENT DOCUMENTS

| | | | |
|---|---|---|---|
| 57945 | 5/1937 | Norway | 280/615 |
| 108122 | 8/1943 | Sweden | 280/615 |

*Primary Examiner*—Joseph F. Peters, Jr.
*Assistant Examiner*—Milton L. Smith
*Attorney, Agent, or Firm*—Holman & Stern

[57] ABSTRACT

A ski-binding device for cross-country skis comprising a base plate fastened to a ski, a movable holder element pivoted as a rocker arm with one end of the holder element engaging the front portion of a ski boot and the other end of the element being tensioned by a lever arm with at least one cam lobe pressing upwards on the holder element. The cam lobe is angled at less than 180° from the lever arm. A spring is provided between the pivot point of the holder element and the area in which the holder element engages the front portion of the ski boot. The spring forces the holder element in a rocker arm fashion out of engagement with the ski boot when the tensioning lever arm is released and additionally retains the tensioning lever arm in a trough-shaped depression when the binding is out of engagement with the ski boot. Pins resting in selectively-utilizable boreholes are mounted on the block portion of the base plate for engagement with the front portion of the ski boot from below. Teeth-like projections are provided on the engaging end of the holder element for engaging with the front portion of the ski boot. The end of the tensioning lever arm opposite from the cam lobe is shaped as a handle-grip. The holder element is shaped like a wedge and is hollow with internally reinforcing ribs and a cover. A U-shaped recess is provided in the forward end of the holder element to permit the extension therethrough of the tensioning lever arm.

12 Claims, 6 Drawing Figures

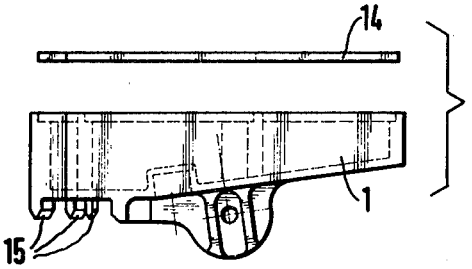
FIG. 3
FIG. 4
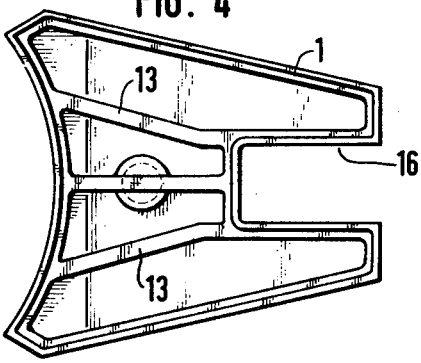
FIG. 5
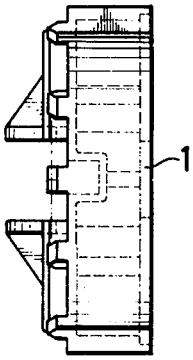
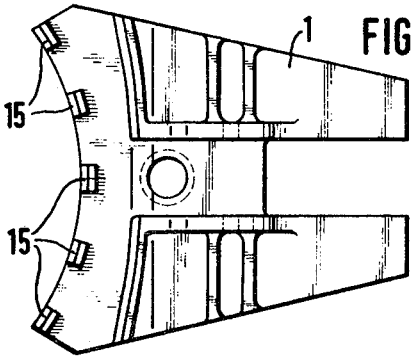
FIG. 6

SKI-BINDING DEVICE FOR CROSS-COUNTRY SKIS

BACKGROUND OF THE INVENTION

The present invention relates to a ski-binding device and more particularly, to a ski-binding device for cross-country skis.

Ski-bindings are known in the prior art having a movable holder element which from above affects the front portion or corresponding projection on a ski boot and holds the same against a block. The block is provided with pins which engage the front portion of a ski boot (either the sole or a projection thereof) from below. Ski-bindings for cross-country skis are constructed so as to generally flexibly connect only the front portion of the ski boot with the ski. This is so that the heel of the ski boot can be lifted off the ski when in use. In prior art ski-bindings, a metal handle is generally provided which is attached adjacent to or below the ski boot in the vicinity of the front portion thereof. This prior art metal handle, for the purpose of locking the binding, can be pressed downwards and locked. Thus the metal handle in securing the front portion of the ski boot serves as the holder element.

The prior art ski-binding has the disadvantage that it protrudes laterally from the ski, it streaks easily in the snow and is somewhat difficult to handle. This is especially so when the individual parts of the binding device are partially covered with snow and ice. Additionally, the prior art binding devices lack a sufficient degree of adaptation to the varying thicknesses of soles of various different ski boots and additionally cannot take into account any changes due to wear and tear of the ski boot.

SUMMARY AND OBJECTS OF THE INVENTION

The objects of the present invention are to provide a ski-binding which is comparatively simple to manufacture, easier to handle, easily and effectively adaptable to varying sizes of ski boots, and having only minor lateral dimensions.

The present invention is a ski-binding device for cross-country skis comprising a base plate having a longitudinal axis, means for fastening the base plate to a ski, a movable holder element, a plurality of upwardly projecting pins, and tensioning means. The base plate comprises a block portion, a pivot-bearing member, and a forward portion. The base plate is oriented with the forward portion towards the tip of the ski. The movable holder element has a forward end, a rearward end and a fulcrum portion with the fulcrum portion being positioned between the forward and rearward ends. The fulcrum portion is pivotably engaged with the pivot bearing member of the base plate. The rearward end of the holder element is shaped to engage a front portion of a ski boot from about and hold the same against the block portion of the base plate. The pins are replacably mounted in the block portion of the base plate for engaging the front portion of the ski boot from below. The tensioning means are engaged with the holder element for holding the rearward end in engagement with the front portion of the ski boot. The forward portion of the base plate has a supporting means for supporting and retaining the tensioning means.

The rearward end of the holder element can be provided with downwardly directed tooth-like projections for engaging the front portion of the ski boot. Preferably, the holder element functions like a rocker arm, with the tensioning means operatively engaged with the forward end of the holder element. The block portion can be provided with a plurality of selectively-utilizable boreholes for the replacable mounting of the plurality of pins. In this manner, the ski-binding can be adapted for different sizes of ski boots by providing different pin-configurations.

A spring means can be provided for holding the holder element open when the tensioning means is not engaged. The spring means is compressionally mounted between the base plate and the rearward end of the holder element.

The tensioning means preferably comprises a lever arm having two ends, the first end being shaped as a handle grip and the second end being rotationally associated with the support means for the tensioning means. The second end has at least one cam lobe shaped thereon in an angle less than 180° from the axis of the lever arm. Thus at least one cam lobe presses against the forward end of the holder element to hold the rearward end in engagement with the front portion of the ski boot. The tensioning lever arm rests in a trough-shaped depression in the base plate and is retained in place when the binding is not in use by the spring pushing the holder element downwardly onto the tensioning means. Different sizes of cam lobes can be utilized on different lever arms to provide for variations in ski boot sizes. Since the lever arm merely rests in the trough-shaped depression, it is easily replaceable to accommodate different boot sizes.

The holder element can be constructed as a box-shaped hollow structure having internal reinforcing ribs. The structure is most preferably shaped as a wedge with the narrow end pointing towards the tip of the ski and forming the forward end of the holder element. The rearward end of the holder element can be shaped to be adaptable to the front portion of ski boots. A cover can be provided to seal the structure and to possibly carry advertising, labelling, and the like. The forward end of the wedge-shaped structure can be provided with a U-shaped recess to permit the extension of the lever arm therethrough.

The pivot bearing member of the base plate can be constructed as an upwardly extending arm having a pivot pin receiving hole therethrough which is aligned perpendicular to the longitudinal axis of the base plate. A pivot pin extends through the fulcrum portion of the holder element and the pivot pin receiving hole of the pivot bearing member to rockably secure the holder element to the base plate.

The substantial parts of the binding, namely, the base plate, the tensioning means, and the holder element can be made of a synthetic material. In this manner, the manufacture and the structure of the same are substantially simplified.

The present invention provides various advantages over the prior art. The construction of the holder element as a rocker arm permits the tensioning of the same to be obtained by means of comparatively simple structural parts. Thus, the construction is very simple without sacrificing any efficiency of the binding itself. The entire binding can be arranged in front of the ski boot and requires only a very limited width. The portions of the binding do not, or only to a comparatively small extent, protrude laterally over the ski. It is especially noted that the binding portions are not wider than the ski boot itself. The construction of the tensioning means is simplified so that it is easy to handle even when partially covered with snow and ice.

The obtainment of the above and other objects will become immediately apparent to the person having ordinary skill in the art when viewing the drawings and the following detailed description of a preferred embodiment.

BRIEF DESCRIPTION OF THE DRAWINGS

Throughout the several views of the drawings, like reference numerals refer to like structural parts, wherein

FIG. 3 is an elevational view of the holder element with cover plate;

FIG. 4 is an aerial view of the holder element;

FIG. 5 is an end-view of the holder element; and

FIG. 6 is a bottom view of the holder element.

DETAILED DESCRIPTION OF A PREFERRED EMBODIMENT

Figure 1:
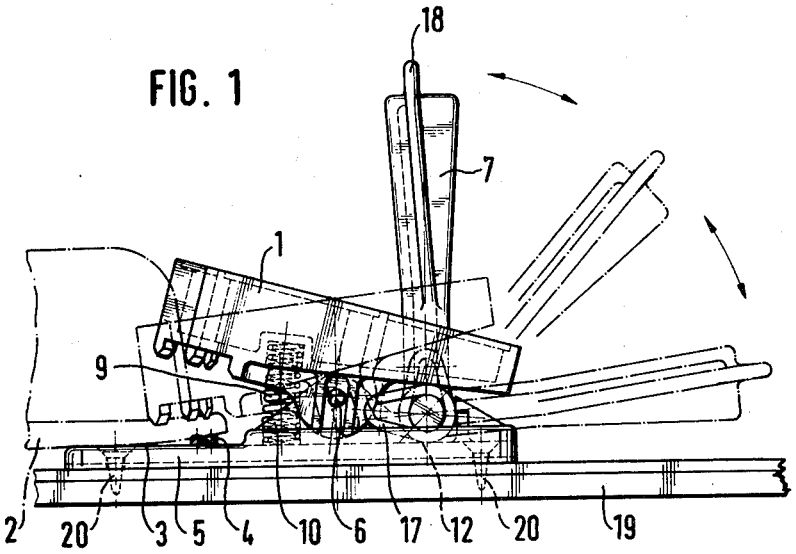
FIG. 1 is a cross-sectional view of a preferred embodiment of the present invention.
Figure 2:
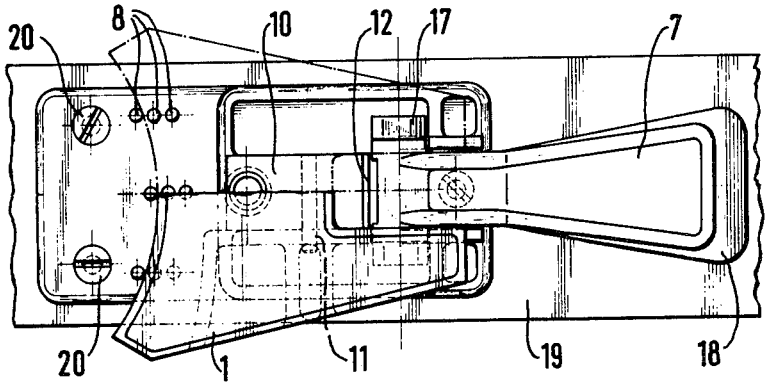
FIG. 2 is an aerial view of the same.

The present invention as shown in the drawings is mounted on a wooden platform intended to represent a portion of a cross-country ski 19. Fastening means 20 are provided to hold the device to the ski 19. These are represented as wood-screws 20. The screws 20 fasten the base plate 5 to the ski 19. Pins 4 are arranged for securing the ski boot 2 from below to the block portion 3 of the base plate 5. Additional boreholes 8 can be provided so that the pins 4 may be selectively inserted into various ones of the boreholes 8 and thus the best-possible mutual arrangement of the ski boot 2 and the holder element 1 can be adjusted.

The base plate 5 can be made of a synthetic material. It carries a pivot bearing member 6 which is shown as an upwardly-extending arm with a hole therethrough for the placement of hinge pin 11, thus forming the pivot bearing 6 of the holder element 1. This construction will provide sufficient space in order to provide sufficient material in the area required by the pin 11. A spring element 9 is provided between the pivot bearing 6 and the end of the holder element 1 which engages the ski boot 2. The spring element 9 moves the holder element 1 into the opening position.

The base plate 5 carries a synclinal bearing 12 for the lever arm 7. The synclinal bearing 12 is shaped as a trough-shaped depression in the base plate 5. The lever is provided with two tensioning cam lobes 17 having eccentric forms. The lobes are oriented at an angle of less than 180° from the longitudinal axis of the lever arm 7. When the lever arm 7 is in the horizontal position, a secure tensioning position will be obtained as the cam lobes will press against the forward end of the holder element 1. The rocker-like construction of the holder element 1 ensures that the rearward end of the holder element 1 presses against the ski boot 2.

The lever arm 7, when in the opened position, is retained by means of the spring 9 which presses against the holder element 1. Thus, the lever arm 7 can easily be removed, mounted or exchanged. By means of varying tensioning levers, various different holding-strengths can be provided. Namely, the size of the cam lobes 17 can be varied on different lever arms. In this manner, it is also possible to take under consideration the various thicknesses of the soles of differing ski boots.

The holder element 1 is of a box-shaped construction and is provided with internal reinforcing ribs 13. A cover plate 14 seals the box and can be utilized in any aesthetic outer form and/or color. Additionally, the cover plate 14 may also support a print of an advertisement or the like. Preferably, the holder element 1 is shaped like a wedge, since this produces the lowest resistance under certain conditions. The U-shaped recess 16 enables the movement of the holder element 1 and the bolt lever 7 and produces the desired compact construction.

In the area of the block portion 3 of the base plate 5, the holder element 1 is provided with downwardly-directed teeth 15 for an improved hold on the front portion of the ski boot 2. The free end portion of the lever arm 7 is provided with a handle-grip 18 which simplifies the operation of engaging the lever arm 7 in the tensioning position and makes the release of the tensioning means very simple by pulling the same upwards to open the binding.

It has been found that the best effects are obtained when all or almost all of the inventive characteristics are applied simultaneously to a ski-binding, however, a partial utilization of the inventive characteristics will result in new and advantageous effects. Thus, the objects of the present invention are clearly obtained in the above-described preferred embodiment.

What is claimed is:

1. A ski-binding device for cross-country skis comprising a base plate having a longitudinal axis, said plate comprising a block portion, a pivot bearing member, and a forward portion; means for fastening said base plate to a ski, said base plate being oriented with said forward portion towards the tip of the skis; a movable holder element having a forward end, a rearward end and a fulcrum portion, said fulcrum portion being between said forward and rearward ends and being pivotally engaged with said pivot-bearing member of said base plate, said rearward end being shaped to engage from above a front portion of a ski boot and hold the same against said block portion of said base plate; a plurality of upwardly projecting pins replaceably mounted in said block portion for engaging from below the front portion of the ski boot; and tensioning lever means rotationally supported on the forward portion of the base plate and operatively engageable with said forward end of said holder element for holding said rearward end in engagement with the front portion of the ski boot, said forward portion of said base plate having supporting hearing means for supporting and removably retaining said tensioning lever means; said holder element, said base plate, and said tensioning means being made of a synthetic material.

2. The device of claim 1, wherein said block portion has a plurality of selectively-utilizable boreholes for the replacable mounting of said plurality of pins.

3. The device of claim 1 further comprising spring means compressionally mounted between said base plate and said rearward end of said holder element for pushing said rearward end out of engagement with the front portion of the ski boot when said tensioning lever means is released.

4. The device of claim 1, wherein said holder element is a hollow wedge-shaped box structure with the narrower end of the wedge shape being said forward end and the wider end of the wedge shape being said rearward end, said structure having internal reinforcing ribs; and a cover.

5. The device of claim 1 wherein said pivot bearing member comprises at least one upwardly extending arm having a pivot pin receiving hole therethrough aligned perpendicular to said longitudinal axis of said base plate and a pivot pin mounted in said hole engaging said fulcrum portion of said holder element 6. A ski-binding device for cross-country skis comprising a base plate having a longitudinal axis, said plate comprising a block portion, a pivot bearing member, and a forward portion; means for fastening said base plate to a ski, said base plate being oriented with said forward portion towards the tip of the skis; a movable holder element having a forward end, a rearward end and a fulcrum portion, said fulcrum portion being between said forward and rearward ends and being pivotally engaged with said pivot-bearing member of said base plate, said rearward end being shaped to engage from above a front portion of a ski boot and hold the same against said block portion of said base plate; a plurality of upwardly projecting pins replaceably mounted in said block portion for engaging from below the front portion of the ski boot; and tensioning means engaged with said holder element for holding said rearward end in engagement with the front portion of the ski boot, said forward portion of said base plate having supporting means for supporting and retaining said tensioning means; said holder element, said base plate, and said tensioning means being made of a synthetic material; said tensioning means comprises a lever arm having a longitudinal axis, a first end and a second end, said first end being shaped as a handle grip, and said second end being rotationally associated with said support means and having at least one cam lobe at an angle less than 180° from said longitudinal axis of said lever arm, said at least one lobe pressing against said forward end of said holder element to hold said rearward end in engagement with the front portion of the ski boot.

7. The device of claim 6 wherein said rearward end of said holder element has downwardly directed tooth-like projections for engaging the front portion of the ski boot and said tensioning means is operatively engaged with said forward end of said holder element.

8. The device of claim 6 wherein said holder element is a hollow wedge-shaped box structure with the narrower end of the wedge shape being said forward end and the wider end being said rearward end, said structure having internal reinforcing ribs; and a cover; said forward end having a U-shaped recess through which said lever arm can extend.

9. The device of claim 6, wherein said support means comprises a trough-shaped depression in said forward portion of said base plate perpendicular to said longitudinal axis, said second end of said tensioning means resting in said depression.

10. The device of claim 9, further comprising spring means compressionally mounted between said base plate and said rearward end of said holder element for pushing said rearward end out of engagement with the front portion of the ski boot when said tensioning means is released, said spring means pressing said forward end of said holder element onto said second end of said tensioning means to retain the same in said depression when said tensioning means is released.

11. The device of claim 6 wherein said pivot bearing member comprises at least one upwardly extending arm having a pivot pin receiving hole therethrough aligned perpendicular to said longitudinal axis of said base plate and a pivot pin mounted in said hole engaging said fulcrum portion of said holder element.

12. The device of claim 6, wherein said block portion has a plurality of selectively-utilizable bore holes for the replaceable mounting of said plurality of pins.

* * * * *